United States Patent [19]

Barnard

[11] 4,108,122

[45] Aug. 22, 1978

[54] AIR/FUEL RATIO FOR AN INTERNAL COMBUSTION ENGINE CONTROLLED BY GAS SENSOR IN INTAKE MANIFOLD

[75] Inventor: Daniel Dewey Barnard, Farmington Hills, Mich.

[73] Assignee: The Bendix Corporation, Southfield, Mich.

[21] Appl. No.: 763,378

[22] Filed: Jan. 28, 1977

Related U.S. Application Data

[63] Continuation of Ser. No. 573,508, Apr. 30, 1975, abandoned.

[51] Int. Cl.[2] ..... F02B 33/00; F02M 25/00

[52] U.S. Cl. ..... 123/119 EC; 123/119 A; 123/32 EJ; 261/DIG. 74; 60/276

[58] Field of Search ..... 123/119 A, 119 EC, 32 EJ; 261/DIG. 74, 39 A, 69 R; 60/276

[56] References Cited

U.S. PATENT DOCUMENTS

| | | | |
|---|---|---|---|
| 1,333,800 | 3/1920 | Kennedy | 60/276 |
| 3,616,274 | 10/1971 | Eddy | 60/276 |
| 3,815,561 | 6/1974 | Beitz | 261/DIG. 74 |
| 3,825,239 | 7/1974 | Rice | 261/50 R |
| 3,844,304 | 10/1974 | Boothe | 261/69 R |
| 3,851,632 | 12/1974 | Teshirozi | 123/119 A |
| 3,855,974 | 12/1974 | Mayer | 261/DIG. 74 |

*Primary Examiner*—Ronald H. Lazarus

*Attorney, Agent, or Firm*—Gaylord P. Haas, Jr.; Russel C. Wells

[57] ABSTRACT

In a closed loop fuel management system for an internal combustion engine, a gas sensor is positioned in the intake manifold and is responsive to a characteristic of the fuel mixture for generating an electrical control signal for controlling the metering of the fuel to the mixture. In the preferred embodiment, the air and fuel are mixed together and the resultant mixture passes by an oxygen gas sensor prior to being distributed to the cylinders through the intake manifold system. The output signal of the sensor is used for controlling the metering of the fuel. Fuel delivery correction delays due to transport lag in conventional closed loop fuel management systems using oxygen gas sensors are eliminated.

8 Claims, 3 Drawing Figures

FIG. 1
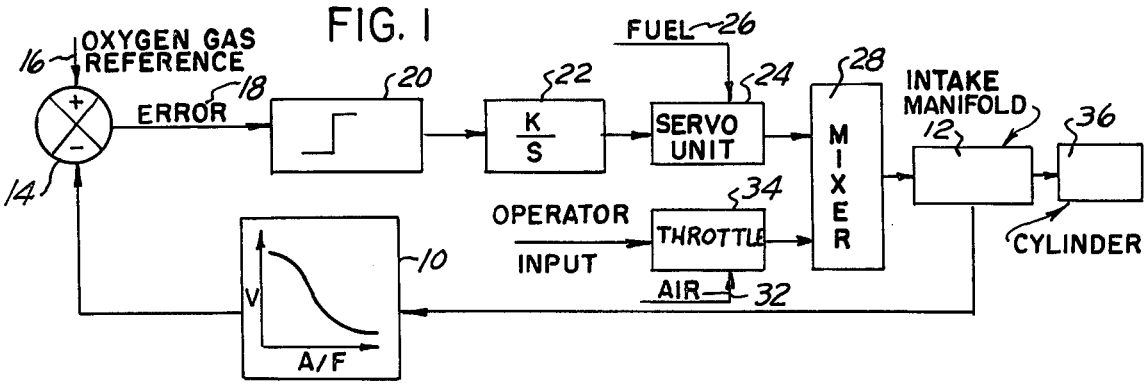
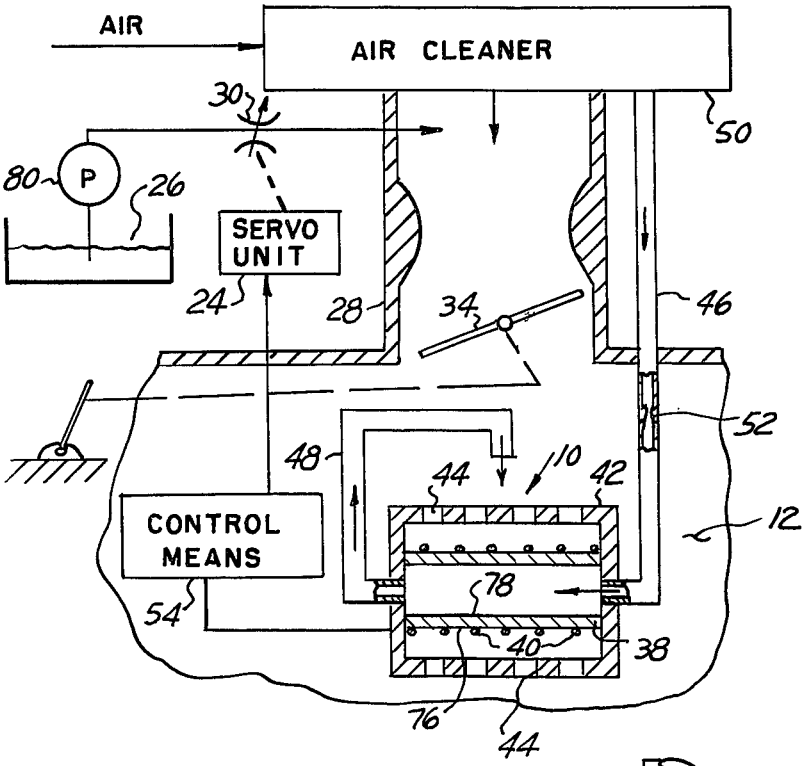
FIG. 2
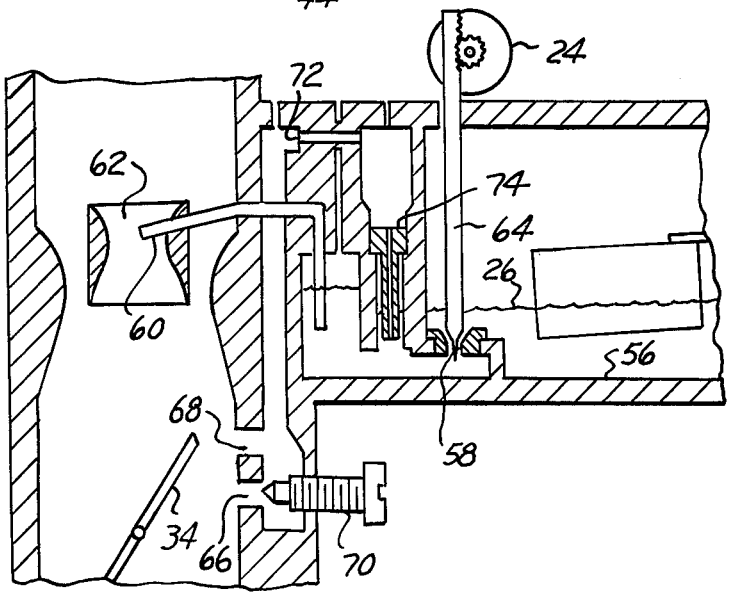
FIG. 3

AIR/FUEL RATIO FOR AN INTERNAL COMBUSTION ENGINE CONTROLLED BY GAS SENSOR IN INTAKE MANIFOLD

This is a continuation, of application Ser. No. 573,508, now abandoned, filed Apr. 30, 1975.

BACKGROUND OF INVENTION

1. Field of Invention

This invention relates in general to fuel management systems for internal combustion engines and, in particular, to control systems responding to the fuel mixture for controlling the amount of fuel supplied to the system.

2. Prior Art

Most fuel management systems can be classified as either an open loop control or a closed loop control system. In the open loop control system, the fuel mixture is preprogrammed and the fuel management system responds only to certain engine operation parameters for selecting the desired fuel mixture. In the closed loop control system, the fuel mixture is also preprogrammed with the fuel management system responding to certain engine operation parameters for selecting the proper fuel mixture; however, with the use of an output sensor, the fuel management system is continuously updated to account for fuel management system tolerances, ambient conditions and for particular engine operating conditions so that the actual air/fuel ratio is substantially equal to the desired proper air/fuel ratio.

Typically most output sensors which respond to the characteristics of the fuel mixture are positioned in the exhaust system of the engine substantially downstream from the point where all the exhaust gases are gathered. This position is generally necessary because most of the sensors are operated at elevated temperatures and the exhaust gases provide the heat source necessary to heat the sensor to its operating temperature. However, this position is a long "time" distance away from the source of the fuel mixture and therefore the response time of the system is slow. Additionally, the system response time is further altered according to the mode of operation of the engine.

By positioning the fuel mixture sensor close to the source of the fuel mixture, the response time is greatly speeded up and in the operation of the fuel management system the actual air/fuel ratio more closely reflects the desired proper air/fuel ratio.

SUMMARY OF THE INVENTION

In an internal combustion engine, a fuel management system having a fuel mixture control unit receives both air and fuel and mixes them together. A throttle valve means is located within the mixture control unit for controlling the amount of air being admitted to the engine in accordance with the operator demands. Fuel is supplied from a source such as a fuel storage tank through an electrically controlled variable fuel discharge means into the mixture control unit upstream of the throttle valve means.

After the fuel is mixed with the air in the mixture control unit, the resultant mixture is distributed to the several cylinders of the engine by means of an intake manifold. Positioned in the intake manifold and responsive to the air/fuel mixture discharging from the mixture control unit is an air/fuel ratio sensor. The sensor generates an electrical signal corresponding to the actual air/fuel ratio of the mixture for applying the signal to the fuel control means for continuously maintaining the actual air/fuel ratio in accordance with the desired air/fuel ratio without any delay in the response time of the fuel management system due to the transport time of the fuel mixture or its resultant mixture to reach a sensing means.

DESCRIPTION OF THE DRAWINGS

In the drawings:

FIG. 1 is a block diagram schematic of the system of the present invention.

FIG. 2 is an illustration of the position of the sensor in the manifold at the exit of the throttle body.

FIG. 3 is one embodiment of the mixture control unit.

DETAILED DESCRIPTION

Referring to the Figures by the characters of reference there is illustrated in FIG. 1 a block diagram of the system of the present invention. The system is used to afford a precise control of the air/fuel mixture for an internal combustion engine where the air and the fuel are mixed at a single point such as a carburetor, as opposed to fuel injection systems wherein the fuel is mixed with the air either within the cylinder or adjacent to the intake valve thereof. In the embodiment of FIG. 1 the air/fuel mixture ratio is measured immediately after the air and the fuel are mixed and therefore closed loop control of the mixture can immediately take place. This present system avoids errors in the fuel mixture due to the problem defined as transport lag within a system.

Referring to FIG. 1 there is illustrated in block diagram a gas sensor 10 positioned in the intake manifold 12 and responsive to the fuel mixture flowing thereby. The output of the sensor 10 is supplied to a summer 14 wherein it is subtracted from a reference voltage 16 to generate an error signal 18. The error signal 18 is then electrically supplied to a comparator 20 for generating a step voltage output. The output of the comparator 20 is supplied to a controller 22 generating a command signal for a servo unit 24. The servo unit 24 meters and measures the flow of fuel 26 into the mixture control 28 through a variable fuel delivery means 30. The flow of air 32 into the mixture control unit 28 is controlled by a throttle valve 34 actuated by the operator of the engine. In the mixture control unit 28 the air 32 and fuel 26 are mixed and discharged into the intake manifold 12. From the intake manifold 12 the air and fuel mixture is supplied to the cylinders 36 for combustion and the exhaust gases are discharged into the exhaust system.

The mixture control unit 28 in FIG. 1 may take the form of any of the well-known fuel mixture units used on internal combustion engines. Such units may be the conventional carburetor or any form of throttle body wherein the air 32 and fuel 26 are mixed for combustion by the engine. The throttle engine 34 is illustrated in the drawings and represents any similar device which is used to control the flow of air and the flow of the resulting fuel mixture into the intake manifold 12.

As illustrated in FIG. 2 the sensor 10 is positioned so as to respond to the fuel mixture leaving the mixture control unit 28. The gas sensor 10 comprises a sensor body 38 in the form of a tube having a heater winding 40 encircling the outside or the inside of the tube. The sensor body 38 is contained within a flame arrester means 42 having a plurality of apertures 44 in the wall of the arrester means 42 allowing the fuel mixture to flow to the sensor body 38. Aligned with either end of the sensor body 38 and the arrester body 42 are an inlet 46 and outlet 48 tube respectively admitting the reference gas which is ambient air into the inside of the sensor body 38 and exhausting it therefrom. The output of the outlet tube 48 is directed so that the reference air is mixed with the fuel mixture and is sensed by the sensor 10.

The inlet tube 46 to the sensor in the preferred embodiment is connected to the air cleaner 50 and due to the vacuum in the intake manifold 12 the air is drawn through the inlet tube 46 through the sensor 10 and through the outlet tube 48. A restrictor 52 is placed in the inlet tube 46 in order to equalize the pressure on the reference side or inside of the sensor 10 to that of the pressure on the outside or the manifold side of the sensor 10. This is necessary because the sensor 10 detects the ratio of the partial pressures of oxygen in the gases on the outside and inside of the sensor.

By discharging the reference gas into the intake manifold 12 the fuel mixture leaving the mixture control unit 28 is made leaner; however, as will hereinafter become apparent by the response of the sensor 10 this added air is compensated for by the addition of more fuel.

In the preferred embodiment the sensor 10 is an oxygen gas sensor wherein the material of the sensor body or cell 38 generates a voltage proportional to the amount of oxygen on either side of the cell. If the cell 38 is fabricated from zirconia, by the use of different stabilizers added to the material different physical and electrical properties can be achieved. Regardless of the stabilizers used, the oxygen sensor cell 38 must be heated to an elevated temperature in order to overcome the output impedance of the cell to therefore generate useable electrical signals.

The electrical output of the sensor cell 38 is connected to a control means 54 comprising the above-indicated summer 14, comparator 20, and controller 22. The output of the control means 54 is coupled to a servo unit 24 for controlling the fuel 26 flow into the mixture control unit 28.

FIG. 3 illustrates one embodiment of the mixture control unit 28 as may be used in the system of FIG. 1. In particular, FIG. 3 is an illustration of a carburetor wherein the fuel 26 flows from the bowl 56 of the carburetor through an orifice 58 comprising the main metering jet to the main discharge tube 60 in the venturi 62 of the carburetor. As is well known the fuel is discharged into the carburetor in response to the air 32 flowing through the venturi 62. Of particular interest in the present application is the control of the main metering jet 58. As illustrated in FIG. 3 the main metering jet is controlled by a two-stage contour needle 64 operating in an orifice 58. As the needle 64 is moved axially through the orifice 58 the size of the orifice changes therefore the amount of fuel 26 flowing from the bowl 56 of the carburetor is controlled. In FIG. 3 the contoured needle 64 is moved axially in and out of the orifice 58 by a servo unit 24 or torque motor electrically responding to the controller 22.

Also illustrated in FIG. 3 are the several idle function elements of the carburetor which operate to supply fuel into the engine during idle. Such elements are the idle port 66, the off-idle port 68, the idle mixture screw 70, idle fuel cross-over port 72, and the idle tube 74. The idle control system also receives fuel 26 from the main metering jet 58 under the control of the needle valve 64 and the torque motor 24.

The sensor used in the embodiment of FIG. 1 is an oxygen gas sensor 10 which is fabricated from a zirconia stabilized material. The outer surface 76 of the sensor body 38 is plated with a catalytic material such as platinum functioning to give the sensor a step voltage output and the inner surface 78 is also plated with electrically conductive material although the inner plating need not be catalytic. The voltage output of the sensor 10 switches from one voltage level to the second voltage level at a predefined air/fuel mixture which in the present embodiment of the oxygen sensor is at or very near to stoichiometric air/fuel ratio. It is apparent that other types of sensors other than an oxygen gas sensor may be used wherein the sensors respond to a predetermined air/fuel ratio and generate an electrical signal indicating whenever the fuel mixture is equal to less than or greater than that predetermined air/fuel ratio.

If the sensor 10 is an oxygen gas sensor a it is necessary that the temperature of the sensor body 38 be elevated above the temperatures normally found in the intake manifold 12 system. A typical minimum operation temperature of the sensor 10 is approximately 700° F. In order to achieve this temperature, a heating winding 40 is wound around the zirconium tube 38 and receives power from an appropriate electrical source in the vehicle (not shown). This heating winding 40 will locally raise the temperature of the sensor 10 to the proper operating temperature allowing the sensor to function. Since this added heat may cause the gas around the sensor to burn, a flame arrestor 42 is provided to contain and prevent any propagation of flame throughout the intake manifold 12.

The reference gas for the sensor 10 is supplied from the ambient air surrounding the engine which has been passed through the air cleaner 50 and piped by means of the inlet tube 46 into the manifold 12 and to the sensor 10. Since the response of the sensor 10 is a function of the change in the oxygen partial pressure across the sensor, it is desirable that the total pressures be equalized or nearly equalized. This is accomplished by providing the restrictor 52 in the inlet tube 46.

The effectiveness of the restrictor 52 depends on the rate of air flow through the restrictor and the size of the restrictor. The rate of idle air flow at idle for small engines (140 cu.in. displacement) is approximately 30 lbs/hr. The pressure downstream of the restrictor is approximately 7 psia and the pressure upstream of restrictor is ambient or approximately 15 psia; therefore the ratio of the downstream to the upstream pressure is 7/15 or 0.46. This gives a restrictor diameter size under sonic air flow conditions of approximately 0.04 in. which, although small, is not too dirt sensitive. Therefore, with such a restrictor 52 in the inlet tube 46, the pressure of the reference gas and the pressure of the fuel mixture in the intake manifold are approximately equal.

The electrical signal generated by the sensor 10 is electrically conducted by a pair of wires one of which is connected to the inside surface and the other is connected to the outside surface of the sensor and is supplied to the control means 54 as indicated in FIG. 2. However, one side of the sensor may be grounded to the same ground as the control means 54 and therefore only one wire would be required. As previously indicated the control means 54 comprises a summer 14 which is responsive to the signal from the sensor 10 and to a signal 16 generated by a voltage threshold device and generates an output therefrom which has both magnitude and direction. The output signal is typically called error signal 18 and in the preferred embodiment if the error signal 18 is positive the mixture is rich and if the error signal is negative the mixture is lean. The error signal 18 is supplied to a comparator 20 means having either one of two outputs of fixed magnitude. The output of the comparator 20 is dependent upon the sign of the error signal 18 being supplied to it. The output of the comparator 20 is electrically connected to a controller or an integrator means 22 the output of which is an electrical signal having either a positive going or a negative going slope thereto. This electrical signal from the integrator means 22 is supplied to a servo unit 24 such as a torque motor of FIG. 3 which controls the amount of fuel 26 flowing into the mixture control unit 28.

With this sensor 10 being positioned substantially at the output of the mixture control unit 28 and in the intake manifold 12, the problems due to transport lag have been greatly minimized and immediately after the air and fuel are brought together for mixing the makeup of the mixture is sensed and the flow of fuel is metered accordingly. It is apparent that by any of the well-known techniques responding to a mixture sensor, the air/fuel ratio of the mixture supplied to an internal combustion engine may be controlled to any desired air/fuel ratio. Biasing signals may be supplied indicating engine operations such as idle, wide-open throttle, and altitude changes so as to continuously monitor the fuel being supplied to the engine for best operation requirements of the engine.

As illustrated in FIGS. 2 and 3, the fuel delivery means is represented as being a variable fuel delivery means. In particular in FIG. 3 is illustrated a two-stage contour needle 64 moving through an orifice valve 58. FIG. 2 represents the fuel delivery means 30 as comprising a variable valve and a pump 80 and the servo unit 24 controlling either the output action of the pump 80 or the opening of the variable valve.

There has thus been shown and described a system for maintaining a desired air/fuel mixture in an intake manifold by measuring the mixture by means of the air/fuel sensor immediately after the mixture is formed and using the electrical intelligence generated by said measurement to control or meter the fuel being supplied to the mixture unit.

I claim:

1. In a fuel management system for an internal combustion engine wherein the fuel and air are mixed in a mixture control means and distributed through intake manifold means to the cylinders of the engine, a system for controlling the air/fuel ratio in the fuel mixture comprising:

variable fuel delivery means for controlling the amount of fuel discharged into the mixture control means;

sensor means positioned in the intake manifold means for directly sensing the oxygen partial pressure in the fuel mixture flowing thereby, said sensor having an electrical characteristic which varies in response to changes in said oxygen partial pressure; and control means responsive to said electrical said sensor for controlling said variable fuel delivery means and controlling the quantity of fuel discharged into the mixture control means in accordance with a function of said electrical characteristic.

2. In the system according to claim 1 wherein said variable fuel delivery means comprises a needle valve means having a preselected contour for providing a variable orifice to control the discharge of fuel from said variable fuel delivery means.

3. In the system according to claim 2 wherein said control means comprises an integrator responsive to said electrical signal from said sensor and a servo motor means coupled to said needle valve means and responsive to the output of said integrator for controlling said needle valve means.

4. In the system according to claim 1 wherein said sensor means is a solid electrolyte oxygen gas sensor.

5. In the system for maintaining a predetermined air/fuel ratio according to claim 4 wherein said control means comprises a voltage threshold means generating a voltage level intermediate said first and second voltage levels of said sensor, comparator means for comparing the output electrical signal from said gas sensor with said voltage threshold means and generating an output electrical signal;

an integrator means responsive to said output electrical signal for generating an electrical signal having a varying amplitude; and a servo unit means responsive to said varying amplitude from said integrator for controlling said variable fuel delivery means.

6. In a fuel management system for an internal combustion engine having a fuel mixture control unit for receiving and mixing air and fuel together, throttle valve means located within the mixture control unit and responsive to the engine operator demands for controlling the amount of air/fuel mixture, electrically controlled fuel control means for discharging fuel into the mixture control unit upstream of said throttle valve means, and intake manifold means for receiving the air/fuel mixture from the mixture control unit and distributing the mixture to the individual cylinders of the engine, the improvement comprising:

sensor means positioned in the intake manifold means and responsive to the air/fuel mixture discharging from the mixture control unit for directly sensing the oxygen partial pressure in the mixture and having an electrical characteristic varying in response to variations in the sensed partial pressure to control the amount of fuel discharged into the mixture control unit for controlling the air/fuel ratio in response to the sensed partial pressure.

7. In the system according to claim 4 wherein said oxygen gas sensor comprises a zirconium body having a catalytically active surface thereon responsive to said fuel mixture and operative to generate a stepped voltage output signal wherein first level indicates the absence of excess oxygen in the fuel mixture and the second level indicates the presence of excess oxygen in the fuel mixture.

8. In the system according to claim 1 wherein said mixture control means controls the air/fuel ratio substantially at stoichiometric.

* * * * *